US009919896B2

(12) United States Patent
Xie et al.

(10) Patent No.: US 9,919,896 B2
(45) Date of Patent: Mar. 20, 2018

(54) DETECTION METHOD FOR ELEVATOR BRAKE MOMENT

(71) Applicant: Otis Elevator Company, Farmington, CT (US)

(72) Inventors: HengFeng Xie, Hangzhou (CN); Shan Li, Hangzhou (CN); Xiaolin Harry Wang, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/104,568

(22) PCT Filed: Dec. 11, 2014

(86) PCT No.: PCT/US2014/069757

§ 371 (c)(1),
(2) Date: Jun. 15, 2016

(87) PCT Pub. No.: WO2015/094905

PCT Pub. Date: Jun. 25, 2015

(65) Prior Publication Data

US 2016/0304314 A1 Oct. 20, 2016

(30) Foreign Application Priority Data

Dec. 19, 2013 (CN) ..... 2013 1 0705100

(51) Int. Cl.
*B66B 1/32* (2006.01)
*B66B 5/00* (2006.01)

(52) U.S. Cl.
CPC ..... *B66B 5/0037* (2013.01); *B66B 5/0025* (2013.01); *B66B 5/0031* (2013.01)

(58) Field of Classification Search
USPC ..... 187/247
See application file for complete search history.

(56) References Cited

U.S. PATENT DOCUMENTS 4,982,816 A * 1/1991 Doi ..... B66B 1/285 187/296
7,222,698 B2 5/2007 Hanninen
(Continued)

FOREIGN PATENT DOCUMENTS

CN 101092223 B 3/2011
CN 102159485 A 8/2011
(Continued)

OTHER PUBLICATIONS

Notification of Transmittal of the International Search Report of the International Searching Authority, or the Declaration; PCT/US2014/069757; dated Mar. 11, 2015, 4 pages.
(Continued)

*Primary Examiner* — Christopher Uhlir
(74) *Attorney, Agent, or Firm* — Cantor Colburn LLP

(57) ABSTRACT

A detection method for elevator brake moment solves the problems that operation of the brake detection device in the prior art is required to be manually executed, the brake detection device is not convenient and facilitative to operate, the function is singular and the brake moment change trend and the brake wear trend cannot be reflected. In the method, by inputting stagewise torque current to the motor and determine whether the torque during rotation of a motor is within the design moment range of a brake, whether torque of the brake is enough can be determined and the brake wear trend can be analyzed according to torque recorded at each time. The method has advantages that the automatic detection is performed periodically, the functions are diversified, the detection accuracy is high, the brake moment change trend can be reflected and the brake wear trend can also be reflected.

5 Claims, 2 Drawing Sheets

(56) References Cited

U.S. PATENT DOCUMENTS

| | | | | |
|---|---|---|---|---|
| 7,268,514 | B2 | 9/2007 | DeLange et al. | |
| 7,350,883 | B2 | 4/2008 | Hubbard et al. | |
| 7,527,127 | B2 | 5/2009 | Oesterman | |
| 7,617,911 | B2 | 11/2009 | Mattila et al. | |
| 7,721,852 | B2 | 5/2010 | Ishioka et al. | |
| 7,896,136 | B2 | 3/2011 | Shibata et al. | |
| 7,938,231 | B2 | 5/2011 | Ueda et al. | |
| 8,205,721 | B2 | 6/2012 | Korhonen et al. | |
| 8,220,599 | B2 | 7/2012 | Fischer | |
| 8,272,482 | B2 | 9/2012 | Takahashi et al. | |
| 8,584,812 | B2 | 11/2013 | Dorsch et al. | |
| 8,602,170 | B2 | 12/2013 | Fischer | |
| 8,686,670 | B2 | 4/2014 | Verheyen et al. | |
| 8,820,484 | B2 | 9/2014 | Rui | |
| 2010/0256843 | A1 | 10/2010 | Bergstein et al. | |
| 2011/0315490 | A1* | 12/2011 | Shi | B66B 5/0025 187/393 |
| 2012/0000731 | A1 | 1/2012 | Schienda et al. | |
| 2012/0217100 | A1* | 8/2012 | Spirgi | B66B 5/0037 187/393 |
| 2013/0220739 | A1 | 8/2013 | Okada et al. | |

FOREIGN PATENT DOCUMENTS

| | | | |
|---|---|---|---|
| CN | 102556784 | A | 7/2012 |
| CN | 102556797 | A | 7/2012 |
| CN | 102596778 | | 7/2012 |
| CN | 202346684 | U | 7/2012 |
| CN | 202599648 | U | 12/2012 |
| CN | 103818792 | A | 5/2014 |
| CN | 103935858 | A | 7/2014 |
| CN | 104010958 | A | 8/2014 |
| CN | 203833408 | U | 9/2014 |
| EP | 2085348 | A1 | 8/2009 |
| EP | 2086810 | A1 | 8/2009 |
| EP | 2364947 | A1 | 9/2011 |
| EP | 2406163 | A1 | 1/2012 |
| EP | 2460753 | A1 | 6/2012 |
| EP | 2773584 | A1 | 9/2014 |
| WO | 2005066057 | A2 | 7/2005 |

OTHER PUBLICATIONS

Notification of Transmittal of the Written Opinion of the International Searching Authority, or the Declaration; PCT/US2014/069757; dated Mar. 11, 2015, 4 pages.

* cited by examiner

DETECTION METHOD FOR ELEVATOR BRAKE MOMENT

FIELD OF THE INVENTION

The present invention relates to an elevator brake control technique, in particular to a detection method for elevator brake moment, which is facilitative and convenient, is high in accuracy and can detect a brake moment change trend and a brake wear trend.

BACKGROUND OF THE INVENTION

The brake of an elevator is an important device for keeping the elevator to be in a static state during stopping. However, in practical use, especially in the elevator which uses a gearless motor, if the moment of a brake is caused to be insufficient due to wear, safety accidents such as over-lifting for a reason that the elevator is out of control may be caused. According to the national standard GB7588-2003, the elevator maintenance company is required to periodically detect whether the brake of the elevator can realize reliable braking or not. However, in practical operation, the detection may be not executed because the detection methods are complicated. Therefore, various brake moment detection devices and detection techniques are designed for preventing the safety accidents from occurring.

At present, common brake moment detection methods depend on additional detection devices and the operation is required to be manually executed. For example, the Chinese utility model patent with the publication number of CN202599648U discloses a brake moment detection device consisting of a manual hydraulic device, a pressure sensor and a signal processor. The operation of the detection device is required to be manually executed and the detection device is not very convenient and facilitative to operate. Moreover, the function is singularly and the wear situation of the brake cannot be predicted.

SUMMARY OF THE INVENTION

The present invention mainly solves the problems that the operation of the brake detection device in the prior art is required to be manually executed, the brake detection device is not convenient and facilitative to operate, the function is singular, and the brake moment change trend and the brake wear trend cannot be reflected, and provides a detection method for elevator brake moment, which is facilitative and convenient, is high in accuracy and can detect the brake moment change trend and the brake wear trend.

The technical problems are solved mainly through the following technical scheme provided by the present invention: the detection method for elevator brake moment is operated through a system consisting of a controller, a motor encoder and a frequency converter and comprises the following steps:

(1). Initiating an automatic detection function to enter a step of elevator running state detection;

(2). Determining, by the controller, whether the elevator is in an idle state; if not, performing the detection till the elevator enters the idle state; and if so, proceeding to the next step;

(3). Controlling, by the controller, the frequency converter to continuously output stagewise-changing torque current to a motor while retaining a brake to be turned off; meanwhile, detecting, by the encoder, whether the motor rotates, and if so, feeding a signal back to the controller, recording the torque during the rotation of the motor, and proceeding to the next step; and (4). Calculating, by the controller, whether the torque during the rotation of the motor is larger than the design moment range of the brake; if so, terminating the detection and restoring the elevator to normal running; and if not, controlling the elevator to enter a fault protection state and stopping the elevator from running.

In the present invention, the brake moment is detected by gradually increasing the output torque of the motor and whether the brake moment is within the design moment range or not is detected through comparison by the controller, so that whether the brake can realize reliable braking or not can be determined. During detection, the controller controls the frequency converter to output stagewise-changing torque current, the torque current is gradually increased from low to high and the stagewise-changing torque current enables the motor to work under gradually increasing torque. Thus, by detecting the brake through multi-stage torques, the detection accuracy is improved and the current moment of the brake can be more accurately detected. By providing the more accurate torque of the brake, the analysis of the data by the controller is facilitated and the use situation of the brake can be further analyzed. The method provided by the present invention is convenient, facilitative and economic to operate. Additional detection devices are not needed, manual operation is not needed, the brake moment is automatically detected through the controller and the time needed is short.

As a preferable scheme, the method further comprises a step of brake wear analysis, the torque during the rotation of the motor is recorded in the step (3) during automatic detection at each time, the controller calculates a brake moment decline curve according to the torques of multiple detections, and if the slope of the curve is larger than a preset slope value and the torque during the rotation of the motor detected in the current automatic detection process is larger than the design moment range of the brake, the controller warns that the brake needs to be maintained in advance. By using the method, the brake wear trend can be analyzed according to the automatic detection results, the warning can be given if the brake needs to be maintained in advance, the use safety of the elevator is further guaranteed and the safety accidents can be better prevented from occurring.

As a preferable scheme, before the automatic detection function is initiated, the cycle of the automatic detection function is set, the controller detects the automatic detection cycle time and the automatic detection function is automatically initiated once it is detected that the cycle time is up. By setting the cycle for the system, the system can automatically and periodically detect the brake, the system initiates the automatic detection function when the cyclic detection time is up and the system enters a waiting state until the next cycle comes.

As a preferable scheme, after the fault protection state is entered, the controller controls the elevator to stop and does not respond to an elevator call command when the controller receives the elevator call command, and till receives the manual turning-on information, the elevator initiates the automatic detection function, and if the moment of the brake is normal, the elevator restores to normal running, otherwise the elevator remains to be stopped. When the elevator enters the fault protection state for a reason that the moment of the brake is not enough, the elevator is not allowed to run again until the operator manually turns on the elevator and the elevator starts to run again after the controller receives the manual turning-on signal, so that the defect that a prompted fault is easily neglected is avoided. Besides, after the operator manually turns on the elevator, the system is required to perform detection once and the elevator restores to normal running if the fault is removed, so that the fault information cannot be cleared until the elevator is repaired and guaranteed to be normal, and the risk that the elevator is not repaired actually due to manual removal of the fault information is avoided.

As a preferable scheme, in the process that the controller controls the frequency converter to output torque current in the step (1), the frequency converter is controlled to increase the output torque current value at each interval of time, the torque current is enabled to gradually change from low to high and the torque current value which is initially output by the frequency converter is larger than a normal torque current value. The output torque current is required to be higher than the normal torque current, i.e. 100% of torque current, the torque current is gradually increased from low to high, the difference of the torque current at two stages can be set according to the needs and the stagewise-changing torque current enables the motor to work under gradually increasing torque.

Therefore, the present invention has the following advantages: 1. the automatic detection is performed periodically, manual operation is not needed, the detection is convenient and facilitative to perform and the time needed is short; 2. the functions are diversified, the moment of the brake is detected in a stagewise change trend, the detection accuracy is high, the brake moment change trend can be reflected and the brake wear trend can also be reflected; and 3. the elevator cannot be turned on until the automatic detection is performed after the fault occurs, and the problem that the elevator is manually turned on before the fault is removed is avoided.

DESCRIPTION OF THE EMBODIMENT

The technical scheme provided by the present invention is described below in detail through the embodiment in combination with the drawings.

Embodiment

Figure 1:
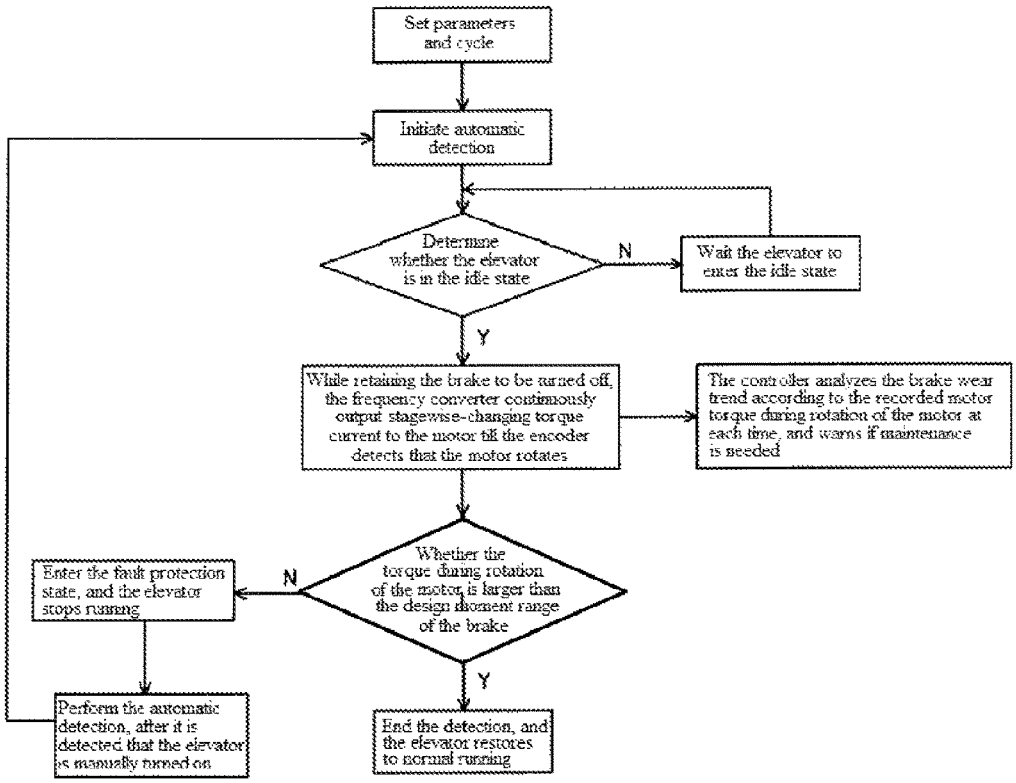
FIG. 1 is a flow chart according to the present invention.

The embodiment provides a detection method for elevator brake moment, which is operated through a system consisting of a controller, a motor encoder and a frequency converter. As shown in FIG. 1, the method comprises the following steps:

Before an elevator is put into use, the relevant parameters and the automatic detection cycle parameter of the elevator are firstly set.

Step 1: after the elevator is turned on for use, the controller monitors whether the automatic detection cycle time is up or not, and if so, the automatic detection function is automatically initiated.

Step 2: the controller determines whether the elevator is in an idle state or not; if not, the elevator waits till the elevator enters the idle state, and then proceeds to the next step; and if so, directly proceeds to the next step.

Figure 2:
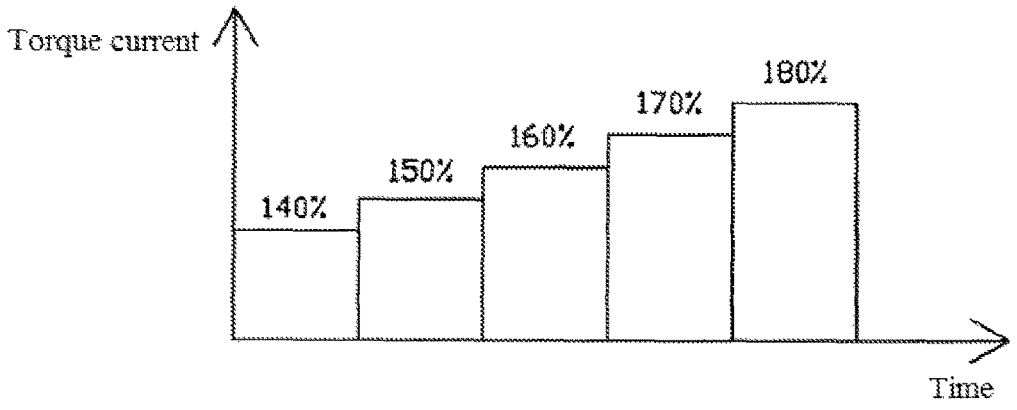
FIG. 2 is a plot of output torque current according to the present invention.

Step 3: a brake is retained to be turned off and the controller controls the frequency converter to continuously output stagewise-changing torque current to a motor, wherein the output torque current is higher than the normal torque current and is gradually increased from low to high, as shown in FIG. 2, 140% of torque current is adopted in the embodiment, the output torque current is increased to 150% of torque current after a period of time and accordingly the output torque current is gradually increased to 180% of torque current under a 10% gradual increase trend; the encoder of the motor detects the rotating situation of the rotating shaft of the motor in real time, and if the rotating shaft of the motor rotates, then proceeds to the next step; and besides, when it is detected that the rotating shaft of the motor rotates at each time, the motor torque during the rotation of the motor is recorded, a brake moment decline curve is calculated according to the torques detected at multiple times, and if the slope of the curve is larger than a preset normal slope value and the torque during the rotation of the motor detected in the current automatic detection cycle is larger than the design moment range of the brake, the controller warns that the brake needs to be maintained in advance.

Step 4: the controller calculates whether the torque during the rotation of the motor is larger than the design moment range of the brake or not; if so, the detection is terminated and the elevator restores to normal running and waits for the next cycle time; and if not, the elevator is controlled to enter a fault protection state, the elevator stops running and proceeds to the next step.

Step 5: if the controller receives a signal of manually turning on the elevator, the elevator performs detection according to the step 2 to the step 4, and if the moment of the brake is normal, the elevator restores to normal running, otherwise the elevator remains to be stopped.

The embodiment described herein is only used for illustrating the spirit of the present invention. Those skilled in the art to which the present invention belongs can make various modifications or additions to the described embodiment or replace the embodiment by adopting the similar method without departing from the spirit of the present invention or going beyond the scope defined in the appended claims.

The invention claimed is:

1. A method for detecting elevator brake moment in an elevator including a controller, a motor, a brake and a frequency converter, the method comprising:

initiating an automatic detection function;

determining, by the controller, whether the elevator is in an idle state;

in response to the elevator not being in the idle state, continuing to perform the determining until the elevator is in the idle state;

in response to the elevator being in the idle state, controlling, by the controller, the frequency converter to continuously output stagewise-changing torque current to the motor while applying the brake and recording a torque at which the motor rotates;

calculating, by the controller, whether the torque at which the motor rotates is larger than a design moment range of the brake;

in response to the torque at which the motor rotates being larger than a design moment range of the brake, terminating the automatic detection function and restoring the elevator to normal running;

in response to the torque at which the motor rotates not being larger than the design moment range of the brake, entering a fault protection state and stopping the elevator from running;

calculating, by the controller, a brake moment decline curve in response to a plurality of recordings of the torque at which the motor rotates; and in response to a slope of the brake moment decline curve being larger than a preset slope and the torque at which the motor rotates being larger than the design moment range of the brake, the controller generating a warning that the brake needs to be maintained.

2. The method of claim 1, wherein:

the automatic detection function is initiated by the controller in response to an automatic detection cycle time.

3. The method of claim 1, wherein:

after the fault protection state is entered, the controller controls the elevator to enter a stopped state and the controller does not respond to an elevator call command when the controller receives the elevator call command.

4. The method of claim 3, wherein:

the controller maintains the elevator in the stopped state until the controller receives a manual turn-on signal;

in response to receiving the a manual turn-on signal, the controller performs the initiating the automatic detection function.

5. The method of claim 1, wherein:

controlling the frequency converter comprises increasing an output torque current value at different intervals of time, so that the torque current changes from low to high;

wherein the torque current which is initially output by the frequency converter is larger than a normal torque current value.

* * * * *